US006427416B1

(12) United States Patent
Rassel

(10) Patent No.: US 6,427,416 B1
(45) Date of Patent: Aug. 6, 2002

(54) CONNECTOR PLATE

(75) Inventor: Douglas A. Rassel, Griffith, IN (US)

(73) Assignee: Aegis Metal Framing LLC, Chesterfield, MO (US)

( * ) Notice: Subject to any disclaimer, the term of this patent is extended or adjusted under 35 U.S.C. 154(b) by 0 days.

(21) Appl. No.: 09/850,311

(22) Filed: May 7, 2001

(51) Int. Cl.[7] ..... E04B 1/38; E04C 5/00

(52) U.S. Cl. ..... 52/714; 52/715; 52/655.1; 52/656.9

(58) Field of Search ..... 52/655.1, 656.9, 52/696, 712, 702, 289, 641, 643, 714, 715, 650.2, 637, 638; 403/230, 231, 232.1, 403

(56) References Cited

U.S. PATENT DOCUMENTS

| | | | | |
|---|---|---|---|---|
| 522,652 | A | | 10/1894 | Costello |
| 625,427 | A | * | 5/1899 | Stewart |
| 813,253 | A | | 2/1906 | Sullivan |
| 1,156,833 | A | | 10/1915 | Bonhard |
| 1,174,097 | A | | 3/1916 | Spear et al. |
| 1,475,078 | A | | 11/1923 | Messacar |
| 1,585,897 | A | | 5/1926 | Davidson |
| 1,765,107 | A | | 6/1930 | Snyder |
| 1,879,459 | A | | 9/1932 | Pelton |
| 2,413,362 | A | | 12/1946 | Maxwell et al. |
| 2,519,628 | A | | 8/1950 | Bothe |
| 3,184,800 | A | | 5/1965 | Nelson |
| 3,216,160 | A | | 11/1965 | Best |
| 3,229,333 | A | | 1/1966 | Hillesheim et al. |
| 3,425,720 | A | | 2/1969 | Spane |
| 3,751,870 | A | | 8/1973 | Vesei |
| 3,798,865 | A | * | 3/1974 | Curtis |
| 3,902,298 | A | | 9/1975 | Ratliff |
| 3,907,445 | A | | 9/1975 | Wendt |
| 3,918,232 | A | | 11/1975 | Edwards |
| 3,945,741 | A | | 3/1976 | Wendt |
| 4,144,683 | A | | 3/1979 | Dean |
| 4,335,555 | A | | 6/1982 | Southerland et al. |
| 4,353,664 | A | | 10/1982 | Gilb |
| 4,433,524 | A | | 2/1984 | Matson |
| 4,464,074 | A | * | 8/1984 | Green |
| 4,498,801 | A | | 2/1985 | Gilb |
| 4,513,554 | A | | 4/1985 | Johnson et al. |
| 4,517,776 | A | * | 5/1985 | Barker |
| 4,525,972 | A | | 7/1985 | Palacio et al. |
| 4,570,400 | A | * | 2/1986 | Slager |
| 4,593,509 | A | | 6/1986 | Linton |
| 4,688,358 | A | | 8/1987 | Madray |
| 4,817,359 | A | | 4/1989 | Colonias |
| 4,893,961 | A | | 1/1990 | O'Sullivan et al. |

(List continued on next page.)

FOREIGN PATENT DOCUMENTS

| | | |
|---|---|---|
| DE | 238822 A1 | 7/1985 |
| EP | 0950817 | 10/1999 |
| FR | 1423034 | 1/1966 |
| GB | 185694 | 10/1922 |

*Primary Examiner*—Carl D. Friedman
*Assistant Examiner*—Kevin McDermott
(74) *Attorney, Agent, or Firm*—Kirkpatrick & Lockhart LLP

(57) ABSTRACT

A connector plate, a building component connection and a method for connecting a first building component to a second building component. The first building component has a first web, a first leg extending outwardly from the first web, and a lip protruding from the first leg to define a toe-receiving area between the lip and the first web. The second building component has a second web and a second leg. The connector plate comprises a back plate for attachment to the second web and may include a side flange for attachment to the first web. The back plate includes a toe sized to be received in the toe-receiving area. The connector plate may include a toe flange that is received on the first leg, a bottom flange that is received on the second leg, and a middle flange. The middle flange and the bottom flange define a lip-receiving notch.

37 Claims, 7 Drawing Sheets

U.S. PATENT DOCUMENTS

| | | | | |
|---|---|---|---|---|
| 4,920,713 | A | | 5/1990 | Borresen et al. |
| 4,932,173 | A | | 6/1990 | Commins |
| 5,042,217 | A | | 8/1991 | Bugbee et al. |
| 5,062,733 | A | | 11/1991 | Cholid et al. |
| 5,109,646 | A | | 5/1992 | Colonias et al. |
| 5,186,571 | A | | 2/1993 | Hentzschel |
| 5,220,766 | A | | 6/1993 | Hills, Sr. |
| 5,236,273 | A | | 8/1993 | Gilb |
| 5,253,465 | A | | 10/1993 | Gilb |
| 5,341,619 | A | | 8/1994 | Dunagan et al. |
| 5,380,115 | A | | 1/1995 | Colonias |
| 5,380,116 | A | | 1/1995 | Colonias |
| 5,419,649 | A | | 5/1995 | Gilb |
| 5,457,927 | A | | 10/1995 | Pellock et al. |
| 5,551,792 | A | | 9/1996 | Witmyer |
| 5,598,680 | A | | 2/1997 | Wilhelmi |
| 5,617,694 | A | | 4/1997 | Baba |
| 5,625,995 | A | | 5/1997 | Martin |
| 5,657,596 | A | | 8/1997 | Powers, III |
| 5,664,392 | A | | 9/1997 | Mucha |
| 5,720,571 | A | | 2/1998 | Frobosilo et al. |
| 5,806,265 | A | | 9/1998 | Sluiter |
| 5,836,131 | A | | 11/1998 | Viola et al. |
| 5,857,306 | A | * | 1/1999 | Pellock |
| 5,906,080 | A | | 5/1999 | DiGirolamo et al. |
| 5,924,259 | A | * | 7/1999 | Marousek |
| 5,983,589 | A | | 11/1999 | Daudet |
| 6,047,507 | A | * | 4/2000 | Lappin |
| 6,050,041 | A | * | 4/2000 | Mowery |
| 6,076,325 | A | | 6/2000 | Sluiter |
| 6,125,594 | A | | 10/2000 | Hudson |
| 6,199,929 | B1 | | 3/2001 | Hansch |
| 6,213,679 | B1 | * | 4/2001 | Frobosilo |
| 6,298,630 | B1 | | 10/2001 | VeRost et al. |
| 6,301,854 | B1 | | 10/2001 | Daudet et al. |

* cited by examiner

CONNECTOR PLATE

BACKGROUND OF THE INVENTION

1. Field of the Invention

The invention relates to building component connections and, more particularly, to a connector plate for connecting two building components.

2. Description of the Invention Background

In the building industry, it is common practice to form the roof of a structure from support members known in the industry as "trusses". In general, a truss typically comprises a collection of interconnected members made from metal or wood. The trusses are supported on the tops of the building walls, and decking materials, also formed from metal or wood, are attached to the trusses to form the roof surface. In some applications, it is advantageous to attach various different types of trusses in order to achieve a desired roof configuration.

A variety of connectors are available for joining a supported wooden truss with a main supporting truss that are used, for example, in the construction of roofs for buildings. Metal connectors such as those disclosed in U.S. Pat. Nos. 5,380,116 and 5,380,115 were designed for wood frame trusses, which typically comprise bulky members with rectangular cross-sections. As noted above, roof trusses have also been fabricated from metal materials. The building construction industry has found metal trusses to be typically lighter in weight than comparable wooden trusses and metal offers superior fire retardant characteristics. Wood or metal trusses must also be supported and stabilized during their interconnection to other portions of the building.

U.S. Pat. Nos. 6,076,325 and 5,806,265 disclose a metal gusset for joining first and second abutting trusses. The gusset includes a slot that is adjusted to fit over an upstanding flange of a bottom chord of a truss to which the gusset is mated, so that the gusset hangs from the upstanding flange. Two gussets are used to connect a secondary truss to a primary truss. This type of connection requires the gussets to be aligned and the trusses must be stabilized while effecting the connection.

U.S. Pat. No. 5,857,306 discloses a one-piece metal connector for connecting a supported truss to a lower chord of a supporting truss at an angle, the lower chord having a cross-section disclosed in the U.S. Pat. No. 5,457,927. This connector includes a first rectangular plate, which engages with the lower chord member of the supported truss, and a second rectangular plate, which is fastened to the web of the lower chord member of the supporting truss. The connector also includes a first flange overlying in engagement with the flange of the lower chord member of the supported truss, and a second flange, which extends over the lip of the lower chord of the supporting truss and above the level of the lip of the lower chord of the supported truss. Such connection still requires stabilizing the trusses during alignment and connection.

There remains, therefore, a need for an improved connector that can be used to connect building components, such as trusses or joists and overcomes limitations, shortcomings and disadvantages of other connectors.

SUMMARY OF THE INVENTION

The various embodiments of the present invention disclosed herein meet the identified needs, as will be more fully understood following a review of this specification and drawings.

One embodiment of the invention includes a building component connection comprising a first building component, a second building component and a connector plate. The first building component has a first web and a first leg that extends generally outwardly from the first web, and a lip protruding from the first leg. The lip defines a toe-receiving area between the first web and the lip. The second building component has a second web and a second leg extending generally outwardly from the second web. The connector plate comprises a back plate, which defines a toe that is sized to be received in the toe-receiving area of the first building component. The back plate also has a bottom edge, which is received on the second leg of the second building component, and may have a middle edge. The middle edge and the bottom edge define a planar notch sized to receive a portion of the lip of the first building component.

The connector plate may further include a side flange protruding from a side of the back plate for attachment to the first web of the first building component. It may also include a toe flange that protrudes from the toe and is sized to be received on the first leg of the first building component, a bottom flange that protrudes from the bottom edge of the back plate and is sized to be received on the second leg of the second building component, and a middle flange that protrudes from the middle edge of the back plate. The middle flange and bottom flange define a spatial notch that is sized to receive a portion of the lip of the first building component. The planar notch on the back plate is the trace of the spatial notch. The middle flange may be continuous with the toe flange, and in one embodiment it forms an angle of 150° thereoff. In another embodiment, the middle flange is parallel with the toe flange.

Another embodiment of the invention includes a method of attaching a first building component to a second building component by providing a connector plate having a back plate defining a toe, and a toe flange, a side flange and a bottom flange, with the flanges protruding from the back plate. The first building component has a first web, a first leg extending generally outwardly from the first web and a lip protruding from the first leg to define a toe-receiving area between the lip and the first web, and the second building component has a second web and a second leg that extends generally outwardly from the second web. The method also includes supporting the bottom flange on the second leg of the second building component and fastening the back plate to the web of the second building component. The method further includes inserting the toe into the toe-receiving area of the first building component, supporting the toe flange on the first leg of the first building component and receiving a portion of the lip of the first leg of the first building component in a notch defined between the bottom flange and a middle flange. In addition, the method may include fastening the side flange to the web of the first building component.

It is a feature of at least one embodiment of the invention to provide a connector for interconnecting a variety of different building components that is easy and safe to install and economical to manufacture.

Another feature of at least one embodiment of the invention is to provide a connector for interconnecting building components that provides rigidity and support to the building components and allows one component to be supported on another component during installation and before final attachment.

Accordingly, various embodiments of the invention provide solutions to the shortcomings of other building component connectors and methods. Those of ordinary skill in the art will readily appreciate, however, that these and other details, features and advantages will become further apparent as the following detailed description proceeds.

BRIEF DESCRIPTION OF THE DRAWINGS

FIG. 7(*b*) is a diagrammatical view showing the connector plate of FIG. 4 in engagement with the first building component;

FIG. 8(*b*) is a diagrammatical view showing the connector plate of FIG. 1 in engagement with the first building component.

DETAILED DESCRIPTION OF THE INVENTION

Figure 1:
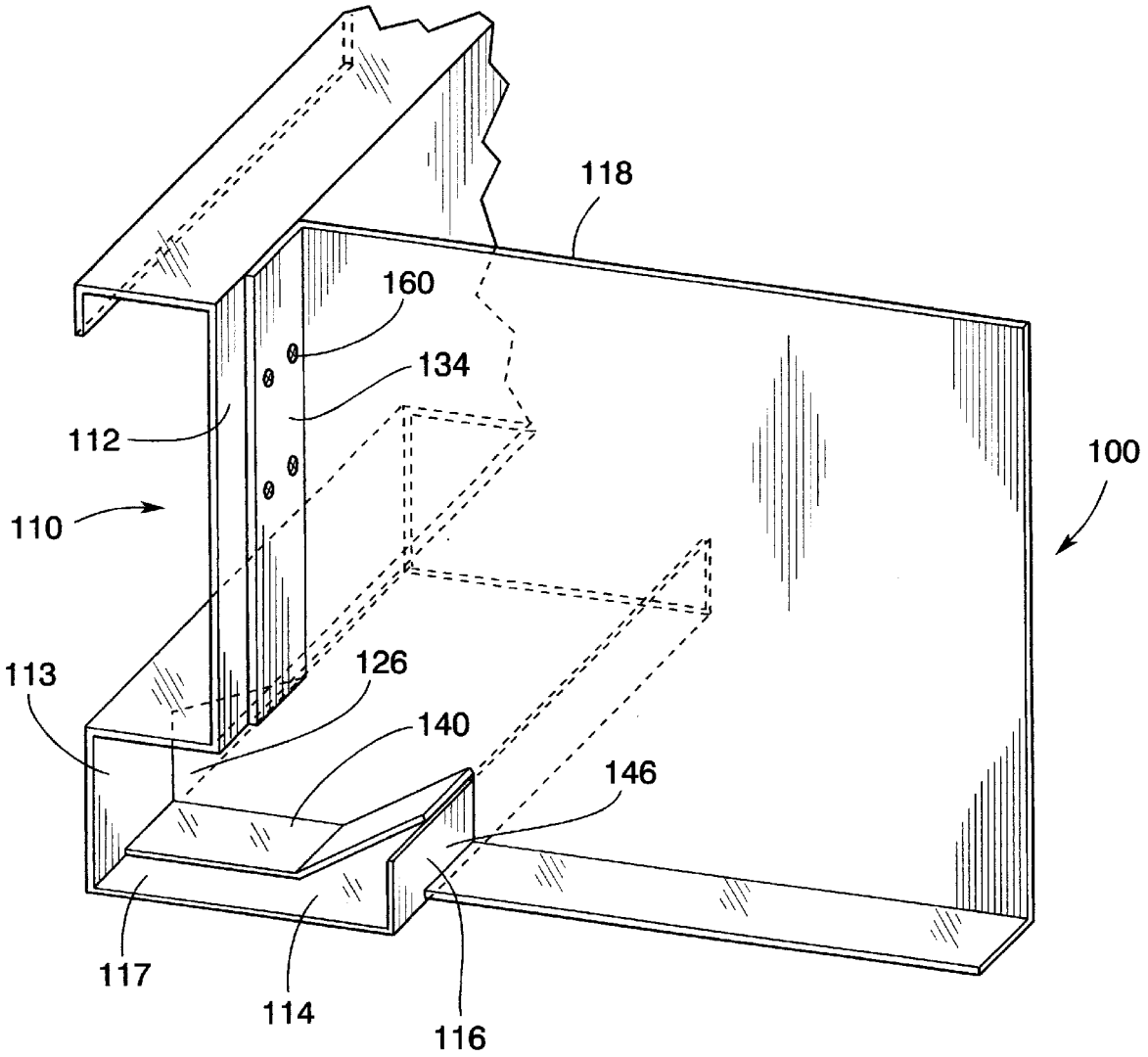
FIG. 1 is a partial isometric view showing an embodiment of a connector plate of the invention in engagement with a first building component.

Referring now to the drawings for the purpose of illustrating the invention and not for the purpose of limiting the same, there is shown various embodiments of a connector plate of the invention for connecting building components, such as, for example, beams, joists, girders, etc. The reader will appreciate that the building components may also comprise components of supporting or supported trusses, such as girder trusses, corner or jack or hip trusses, used, for example, in roof systems. One connector plate embodiment may be used to attach a first building component to a second building component. Generally, the first building component may be any building component having a first web and a first leg extending outwardly from the first web. The first leg may also have a lip protruding from the first leg. A first building component may include, for example, the bottom chord of a girder truss or other supporting truss, or any beam or joist that has a generally L-shaped cross-section that includes a web and a leg, as will be described in more detail herein. The second building component may be any building component having a cross-section that includes a web and a leg generally extending from the web, and may include the bottom chord of a jack truss or other supported truss, or any beam or joist having such cross-section. In addition, it will be appreciated that the characterizations of various components described herein as extending, for example, upwardly or downwardly, or being vertical or horizontal, are relative characterizations only based upon the particular position or orientation of a given component for a particular application. In some roof applications, the first building component may comprise a girder truss that has a horizontal bottom chord with a vertical web, and the second building component may comprise a jack truss that also has a horizontal bottom chord with a vertical web.

Figure 2:
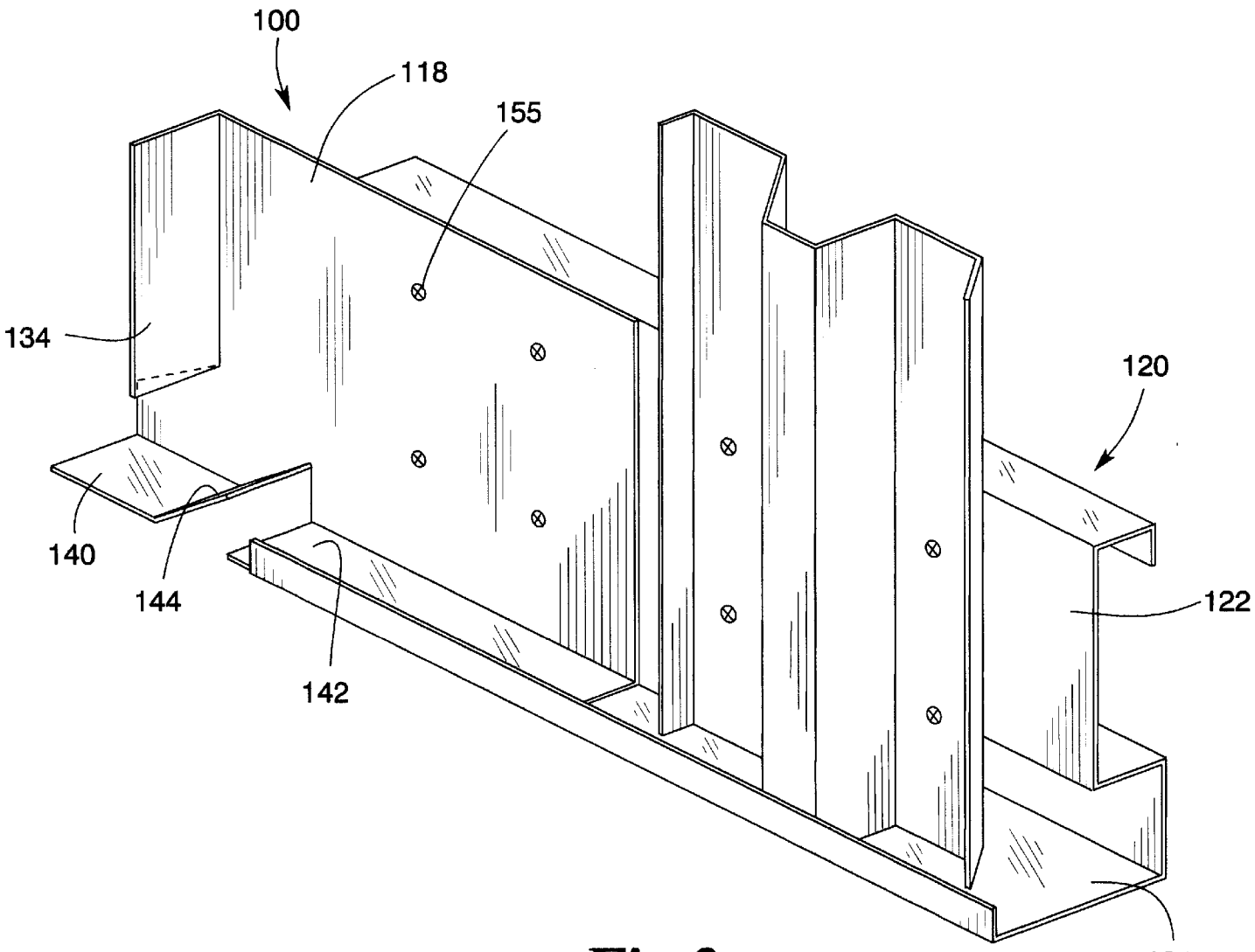
FIG. 2 is a partial isometric view showing the connector plate of FIG. 1 attached to a second building component.
Figure 5:
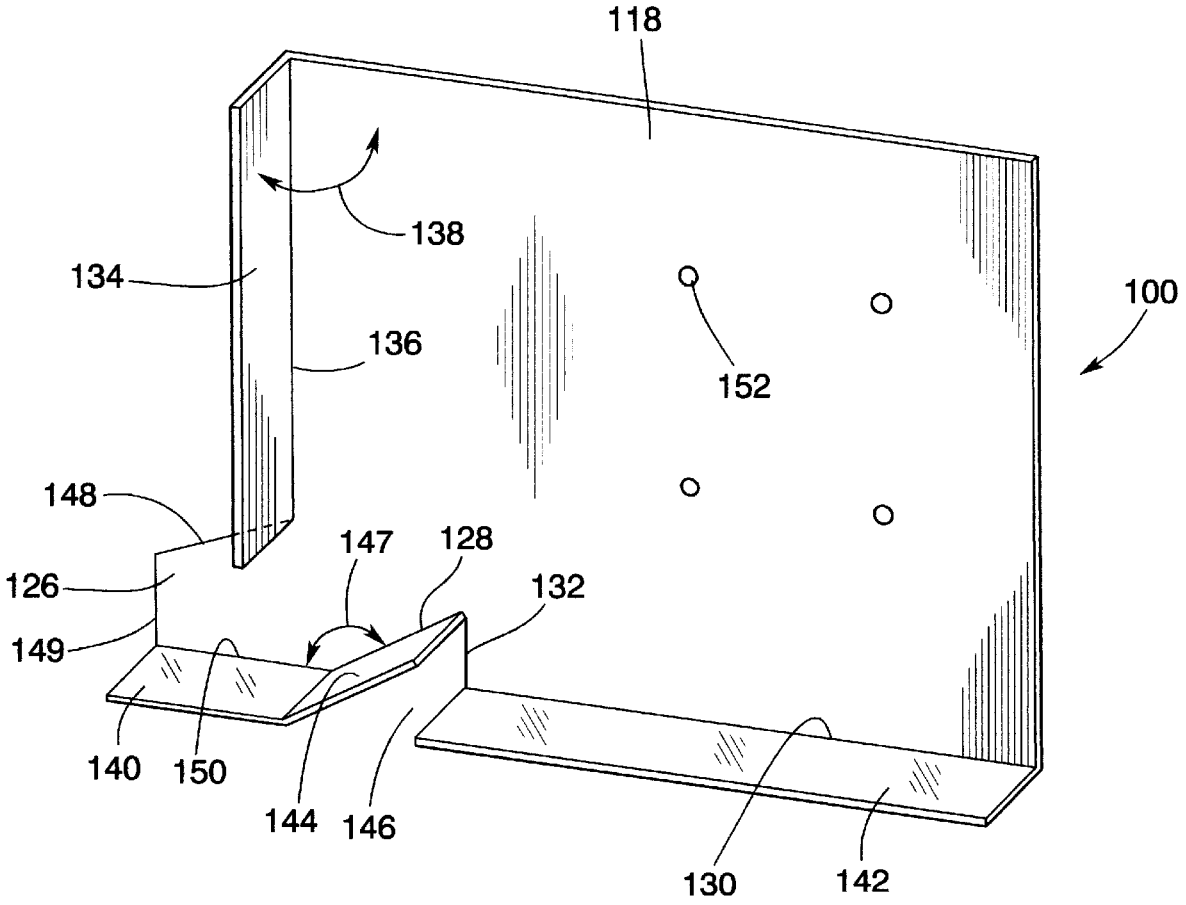
FIG. 5 is an isometric view of the connector plate of FIG. 1.

FIG. 1 is a partial isometric view showing an embodiment of a connector plate 100 of the invention in engagement with a first building component 110. The first building component 110 has a first web 112 and a first leg 114 that extends generally outwardly from the first web 112. The first building component 110 also has a lip 116 that protrudes from the first leg 114. In the embodiment shown in FIG. 1, the lip 116 is parallel to a lower first web portion 113. The lip 116 and the lower web portion 113 define a toe-receiving area, generally designated as 117. The connector plate 100 is shown in FIG. 2 attached to a second building component 120. The second building component 120 has a second web 122 and a second leg 124 extending generally outwardly from the second web 122. The connector plate 100 includes a back plate 118 structured for attachment to the second web 122 of the second building component 120, as shown in FIG. 2. As seen in FIG. 5, the back plate 118 has an area defining a toe 126 that is sized to be received in the toe-receiving area 117 of the first building component 110. In addition, the back plate 118 has a middle edge 128 and a bottom edge 130 that is sized to be received on the second leg 124 of the second building component 120. The middle edge 128 and the bottom edge define a planar notch 132 sized to receive a portion of the lip 116 therein.

The connector plate 100 may further include a side flange 134 that protrudes from a side 136 of the back plate 118. The side flange 134 is structured for attachment to the first web 112 of the first building component 110. The plane of the side flange 134 and the plane of the back plate 118 define an attachment angle 138, which may have, for example, a value of 90° for connecting a girder truss with a jack truss, but may take other values for connecting other building components that are not disposed orthogonally to each other.

In one embodiment, the connector plate 100 further comprises a toe flange 140 that protrudes from the toe 126 and is sized to be received on the first leg 114 of the first building component 110 when the toe 126 is inserted into the toe-receiving area 117, as shown in FIG. 1. The toe flange 140 defines a plane that may be orthogonal with the plane of back plate 118 for applications in which the connector plate is used for building components, such as those shown in FIGS. 1 and 2, which have legs 114, 124 that are orthogonal to the respective webs 112, 122. For other applications, the toe flange 140 need not be orthogonal to the back plate 118 and may be oriented at an angle that is similar to the angle at which the legs 114, 124 are oriented relative to their respective webs 112, 122. The connector plate 100 further includes a bottom flange 142 that protrudes from the bottom edge 130 of the back plate 118 and is received on the second leg 122 of the second building component 120. The connector plate may also include a middle flange 144 that protrudes from the middle edge 128 of the back plate 118. The planes of the middle flange 144 and the bottom flange 142 define a spatial notch 146, i.e. a notch in three-dimensional space, which is sized to receive a portion of the lip 116 of the first leg 114 of the first building component 110. The spatial notch 146 intersects the back plate 118 at the planar notch 132, i.e. the planar notch 132 is the trace of the spatial notch 146 on the back plate 118. The term "notch" without any other qualification is used herein for the spatial notch 146.

The middle edge 128 of the back plate 118 may be straight or curved. In a preferred embodiment, the toe flange 140 and the middle flange 144 define an angle 147 of 150°. See FIG.

Figure 8A:
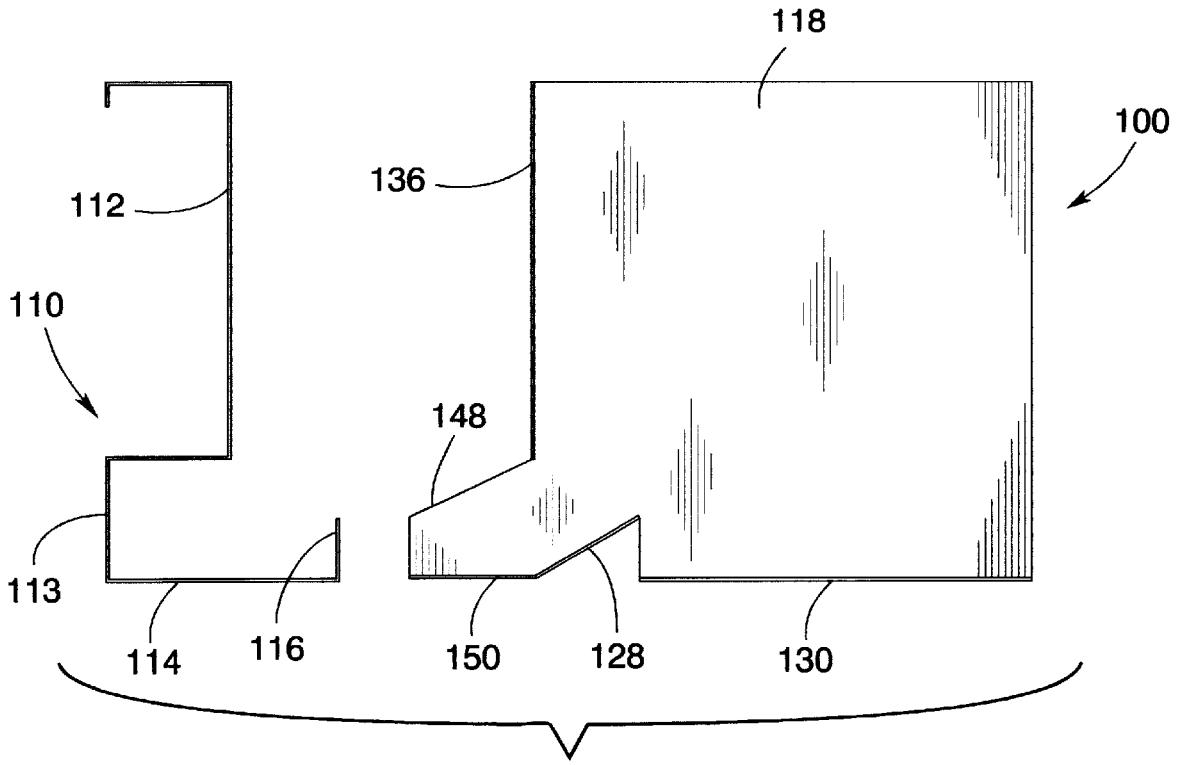
FIG. 8(*a*) is a diagrammatical view showing the connector plate of FIG. 1 before engagement with the first building component.
Figure 8B:
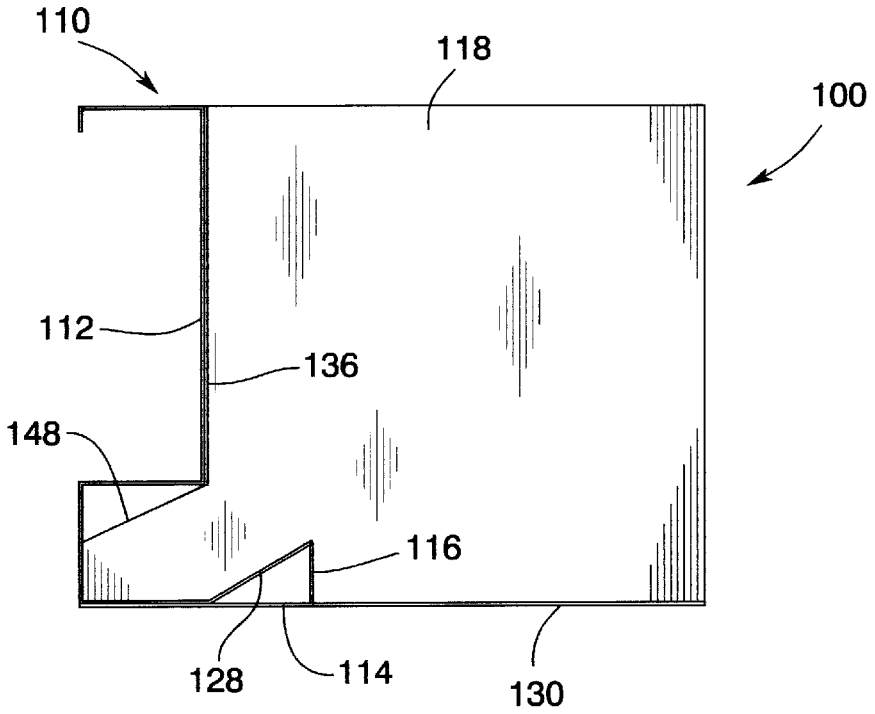

5. The toe 126 has generally a first toe edge 148, a second toe edge 149 and a third toe edge 150. The first toe edge 148 may be parallel to the middle edge 128 of the back plate 118. FIGS. 8(*a*) and 8(*b*) show respectively in schematic profile the connector plate 100 before and after engagement with the first building component 110. The back plate 118 may have pre-punched apertures 152 for easy attachment to the second web 122 of the second building component 120 with fasteners 155, such as, for example, screws and bolts. See FIG. 2. The connector plate 100 may also have embossments on the back plate 118 and/or on any of the flanges 134, 140, 144 and 142.

Figure 6:
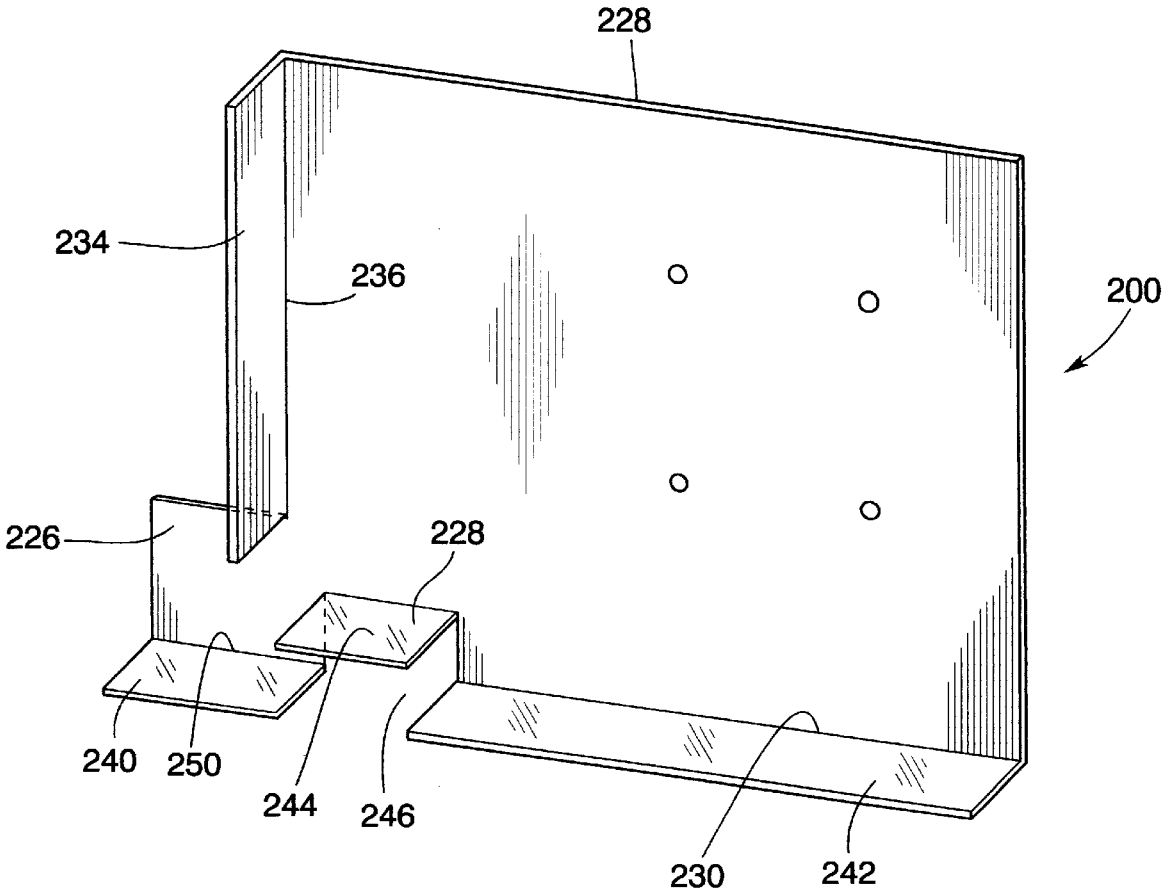
FIG. 6 is an isometric view of the connector plate of FIG. 4.
Figure 7A:
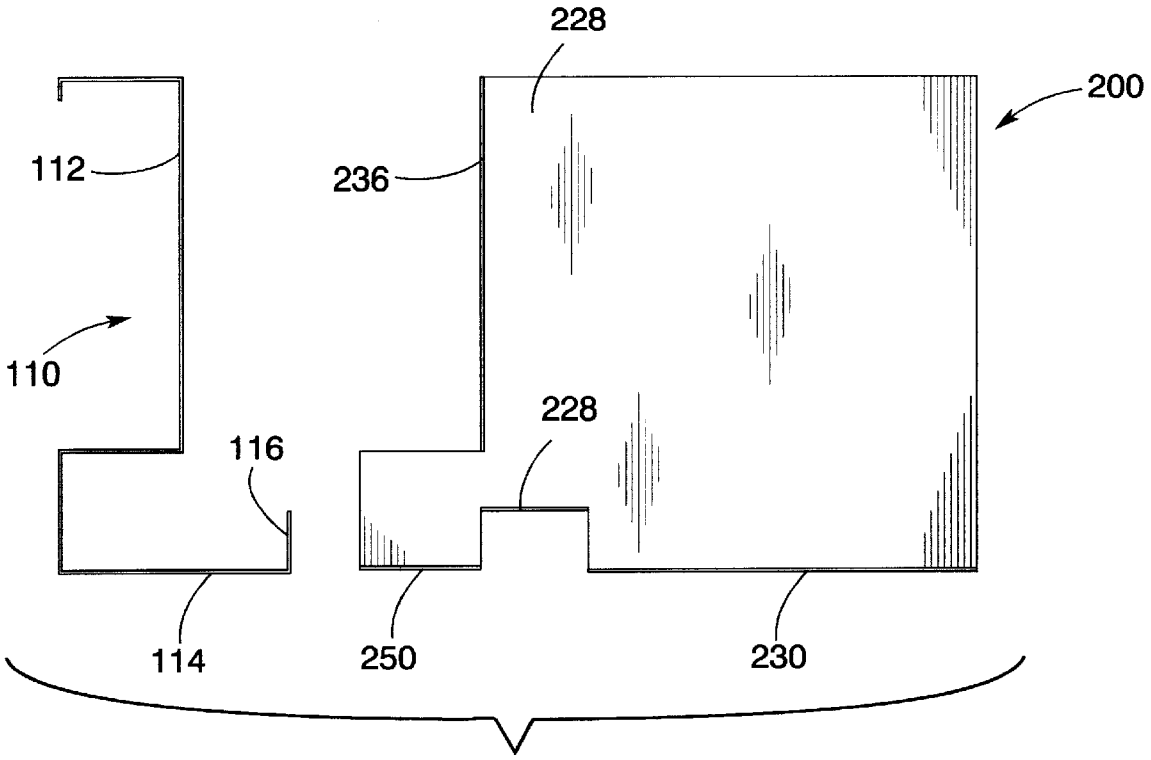
FIG. 7(*a*) is a diagrammatical view showing the connector plate of FIG. 4 before engagement with the first building component.
Figure 7B:
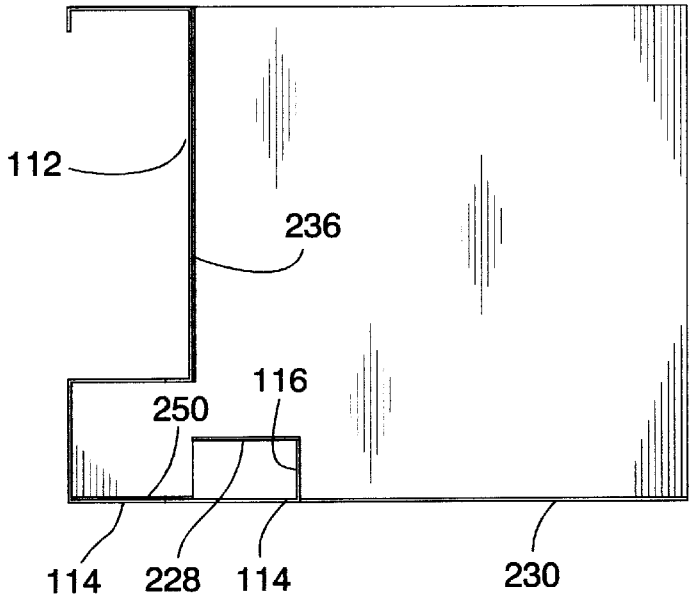

In another embodiment, as shown in FIG. 6, the connector plate 200 has a back plate 228 having a side 236, a toe 226, a toe edge 250, a middle edge 228 and a bottom edge 230. The connector plate 200 also has a side flange 234, a toe flange 240, a middle flange 244 and a bottom flange 242. In this embodiment, the middle flange 244 and the toe flange 240 are parallel. The middle flange 244 and the bottom flange 242 define a notch 246 for receiving a portion of the lip 116 of the first building component 110. FIGS. 7(*a*) and 7(*b*) show respectively in schematic profile the connector plate 200 before and after engagement with the first building component 110.

Figure 3:
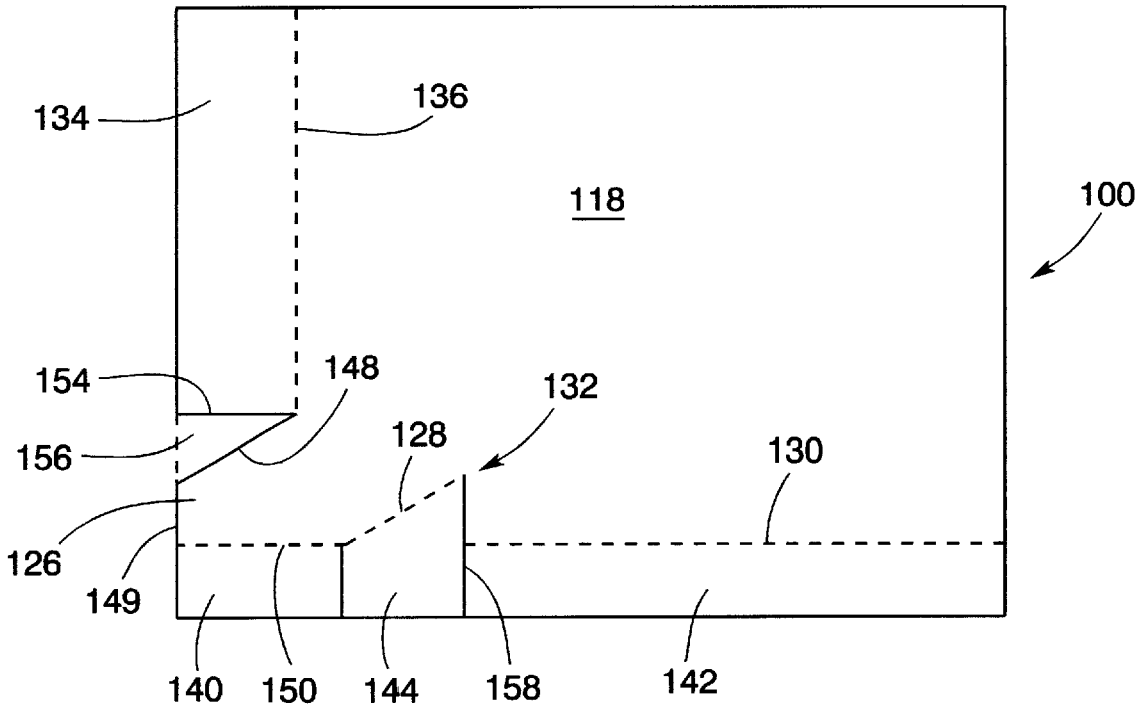
FIG. 3 is an elevational view showing how the connector plate of FIG. 1 can be constructed from a single metal sheet.

The connector plate 100 may be conveniently and economically constructed from a single metal sheet using conventional metal forming techniques and presses as shown in FIG. 3. A triangular cutout 156 is removed by cuts along line 154 of the side flange 134 and edge 148 of the toe 126. A cut is made along line 158 to form the planar notch 132. The flanges 136, 140, 144 and 142 are then bent along the respective edges 134, 150, 128 and 130 at desired angles and the notch 146 that provide clearance for the lip 116 is formed.

Figure 4:
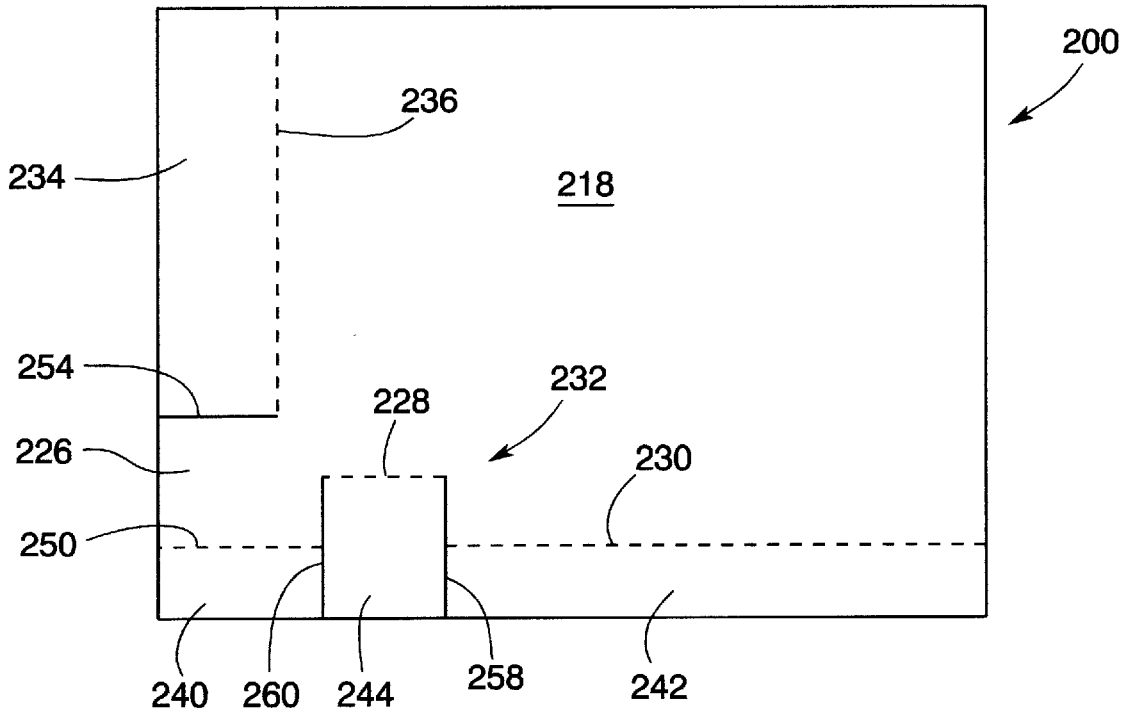
FIG. 4 is an elevational view showing how another embodiment of the connector plate can be constructed from a single metal sheet.

FIG. 4 illustrates another embodiment of the connector plate 200 that may be fabricated from a single metal sheet. A cut is made along edge 254 to separate the toe 226 from the side flange 234. Cuts along lines 260 and 258 are made to separate the middle flange 244 from the toe flange 240 and the bottom flange 242 and to form the planar notch 232. The flanges 234, 240, 244 and 242 are then bent along the respective edges 236, 250, 228 and 230.

Although the above-described construction of the connector plate from a single metal sheet is advantageous for many applications, the connector plate may be constructed in other ways and by other materials, such as, for example, by welding the flanges to the back plate or by molding the entire connector plate using a suitable polymer-based material, or composite, or other man-made materials or material combinations.

In assembling the building connection, the connector plate 100 may be placed so that the bottom flange 142 is received on the second leg 124 of the second building component 120, which may be, for example, the bottom chord of a jack truss 120. The back plate 118 is then attached to the second web 122 of the jack truss. See FIG. 2. The connector plate 100 with the jack truss 120 attached thereto is then slid toward the first building component 110, which can be, for example, the bottom chord of a girder truss, such that the toe 126 and the toe flange 140 are received into the toe-receiving area 117 defined by the lower web portion 113 and lip 116. The side flange 134 is brought into engagement with the first web 112 for attachment thereto. See FIG. 1. The notch 146 allows the installer to temporarily support the connector plate/jack truss system on the first leg 114 of the first building component 110 and adjust the correct location of the two building components before affixing the side flange 134 to the first web 112 of the first building component 110. This process makes the installation easier and safer, and eliminates the need for an additional person to hold the jack truss against the girder truss in correct placement while the final attachment is made. Moreover, when the bottom chord of the girder truss is horizontal, the toe 126 and the toe flange 140 transmit bearing load on the first leg 114 from the weight of the jack truss, and fewer fasteners 160 may be needed to attach the side flange 134 to the first web 112.

Although the above-described method of attaching a first building component to a second building component by means of a connector plate is particularly advantageous for certain connections, the order of attaching the connector plate to the first and second building components may be reversed. Additionally, the size of the connector plate may be adjusted appropriately based on the application and the transmitted loads. For example, the height of the connector plate may be reduced, and the connector plate may be stiffened by added embossments.

Whereas particular embodiments of the invention have been described herein for the purpose of illustrating the invention and not for the purpose of limiting the same, it will be appreciated by those of ordinary skill in the art that numerous variations of the details, materials and arrangement of parts may be made within the principle and scope of the invention without departing from the invention as described in the appended claims.

What is claimed is:

1. A building component connection, comprising:

a first building component having a first web, a first leg extending generally outwardly from the first web, and a lip protruding from the first leg to define a toe-receiving area between the first web and the lip;

a second building component having a second web and a second leg extending generally outwardly from the second web; and a connector plate comprising:

a back plate defining a toe that is sized to be received in the toe-receiving area, a middle edge, and a bottom edge that is received on the second leg of the second building component, and wherein the middle edge and the bottom edge define a planar lip-receiving notch; and a bottom flange that protrudes from the bottom edge of the back plate to be received on the second leg of the second building component and a middle flange that protrudes from the middle edge of the back plate.

2. The building component connection of claim 1, wherein the middle edge is parallel to the bottom edge.

3. The building component connection of claim 1, wherein the connector plate further comprises a side flange protruding from a side of the back plate.

4. The building component connection of claim 1, wherein the connector plate further comprises a toe flange that protrudes from the toe and is received on the first leg of the first building component.

5. A connector plate for connecting a first building component and a second building component, the first building component having a first web, a first leg that extends generally outwardly from the first web, and a lip protruding from the first leg to define a toe-receiving area between the first web and the lip, and the second building component having a second web and a second leg that extends generally outwardly from the second web, the connector plate comprising:

a back plate for attachment to the second web of the second building component, the back plate defining a toe that is sized to be received in the toe-receiving area, a middle edge, and a bottom edge that is received on the second leg of the second building component, and wherein the middle edge and the bottom edge define a planar lip-receiving notch;

a side flange protruding from a side of the back plate for attachment to the first web of the first building component; and a toe flange that protrudes from the toe and is received on the first leg of the first building component.

6. The connector plate of claim 5, wherein the middle edge is parallel to the bottom edge.

7. The connector plate of claim 5, further comprising a bottom flange that protrudes from the bottom edge of the back plate and is received on the second leg of the second building component.

8. The connector plate of claim 7, further comprising a middle flange that protrudes from the middle edge of the back plate.

9. A building component connection, comprising:

a first building component having a first web, a first leg extending generally outwardly from the first web, and a lip protruding from the first leg to define a toe-receiving area between the first web and the lip;

a second building component having a second web and a second leg extending generally outwardly from the second web; and a connector plate comprising:

a back plate defining a toe;

a toe flange protruding from the toe, wherein the toe and the toe flange are sized to be received in the toe-receiving area;

a bottom flange that protrudes from the back plate such that it is not coplanar with the back plate and is received on the second leg of the second building component; and a middle flange disposed between the toe flange and the bottom flange, wherein the middle flange and the bottom flange define a lip-receiving notch.

10. The building component connection of claim 9, wherein the connector plate further comprises a side flange protruding from a side of the back plate for attachment to the first web of the first building component.

11. The building component connection of claim 9, wherein the toe has an edge that is parallel to an edge of the middle flange.

12. The building component connection of claim 9, wherein the middle flange and the toe flange are oriented at an angle of 150° relative to each other.

13. The building component connection of claim 9, further comprising a plurality of fastener apertures through the back plate of the connector plate.

14. The building component connection of claim 9, wherein the first building component is a bottom chord member of a girder truss and the second building component is a bottom chord member of a jack truss.

15. The building component connection of claim 9, wherein the connector plate is formed from a material selected from the group consisting of metal and polymer materials.

16. The building component connection of claim 9, wherein the connector plate is formed from a single metal sheet.

17. The building component connection of claim 9, wherein the middle flange of the connector plate is parallel to the toe flange.

18. The building component connection of claim 9, wherein the middle flange of the connector plate is continuous with the toe flange.

19. A building component connection, comprising:

a first building component having a first web, a first leg extending generally outwardly from the first web, and a lip protruding from the first leg;

a second building component having a second web and a second leg extending generally outwardly from the second web; and a connector plate comprising:

means for supporting the connector plate on the first leg of the first building component;

means for supporting the connector plate on the second leg of the second building component;

means for connecting the connector plate to the first web of the first building component;

means for connecting the connector plate to the second web of the second building component; and notch means for providing clearance for the lip of said first building component, said notch means formed in said means for connecting the connector plate to the second building component.

20. A connector plate for connecting a first building component and a second building component, the first building component having a first web, a first leg that extends generally outwardly from the first web, and a lip protruding from the first leg to define a toe-receiving area between the first web and the lip, and the second building component having a second web and a second leg that extends generally outwardly from the second web, the connector plate comprising:

a back plate defining a toe;

a toe flange protruding from the toe, wherein the toe and the toe flange are sized to be received in the toe-receiving area;

a bottom flange that protrudes from the back plate such that it is not coplanar with the back plate; and a middle flange disposed between the toe flange and the bottom flange, wherein the middle flange and the bottom flange define a lip-receiving notch.

21. The connector plate of claim 20, further comprising a side flange protruding from a side of the back plate.

22. The connector plate of claim 20, wherein the toe has an edge that is parallel to an edge of the middle flange.

23. The connector plate of claim 20, wherein the middle flange and the toe flange are oriented at an angle of 150° relative to each other.

24. The connector plate of claim 20, further comprising a plurality of fastener apertures through the back plate of the connector plate.

25. The connector plate of claim 20, wherein the first building component is a bottom chord member of a girder truss and the second building component is a bottom chord member of a jack truss.

26. The connector plate of claim 20, wherein the connector plate is formed from a material selected from the group consisting of metal and polymer materials.

27. The connector plate of claim 20, wherein the connector plate is formed from a single metal sheet.

28. The connector plate of claim 20, wherein the middle flange is parallel to the toe flange.

29. The connector plate of claim 20, wherein the middle flange is continuous with the toe flange.

30. A method of attaching a first building component to a second building component, the first building component having a first web, a first leg extending generally outwardly from the first web, and a lip protruding from the first leg to define a toe-receiving area between the first web and the lip, and the second building component having a second web and a second leg that extends generally outwardly from the second web, the method comprising:

providing a connector plate having a toe flange, a side flange, a middle flange, a bottom flange, and back plate defining a toe;

supporting the bottom flange on the second leg of the second building component;

fastening the back plate to the second web of the second building component;

placing the toe in the toe-receiving area of the first leg of the first building component;

supporting the toe flange on the first leg of the first building component; and receiving a portion of the lip of the first leg of the first building component in a notch defined between the bottom flange and the middle flange.

31. The method of claim 30, further comprising:

fastening the side flange to the first web of the first building component.

32. The method of claim 30, wherein the toe flange and middle flange are oriented at an angle of 150° relative to each other.

33. A building component connection comprising:

a first building component having a first web, a first leg extending generally outwardly from the first web, and a lip protruding from the first leg to a toe-receiving area between the first web and the lip;

a second building component having a second web and a second leg extending generally outwardly from the second web; and a connector plate comprising:

a back plate, the back plate defining a toe that is sized to be received in the toe-receiving area, a middle edge, and a bottom edge that is received on the second leg of the second building component, and wherein the middle edge and the bottom edge define a planar lip-receiving notch;

a side flange protruding from said back plate to be received on the first leg of the first building component; and a toe flange that protrudes from the toe and is received on the first leg of the first building component.

34. The building component connection of claim 33, wherein the middle edge is parallel to the bottom edge.

35. The building component connection of claim 33, wherein the connector plate further comprises a bottom flange that protrudes from the bottom edge of the back plate and is received on the second leg of the second building component.

36. The building component connection of claim 33, wherein the connector plate further comprises a middle flange that protrudes from the middle edge of the back plate.

37. A connector plate for connecting a first building component and a second building component, the first building component having a first web, a first leg that extends generally outwardly from the first web, and a lip protruding from the first leg to define a toe-receiving area between the first web and the lip, and the second building component having a second web and a second leg that extends generally outwardly from the second web, the connector plate comprising:

a back plate for attachment to the second web of the second building component, the back plate defining a toe that is sized to be received in the toe-receiving area, a middle edge, and a bottom edge that is received on the second leg of the second building component, and wherein the middle edge and the bottom edge define a planar lip-receiving notch;

a bottom flange that protrudes from the bottom edge of the back plate and is received on the second leg of the second building component; and a middle flange that protrudes from the middle edge of the back plate.

* * * * *

UNITED STATES PATENT AND TRADEMARK OFFICE

CERTIFICATE OF CORRECTION

PATENT NO. : 6,427,416 B1
DATED : August 6, 2002
INVENTOR(S) : Douglas A. Rassel It is certified that error appears in the above-identified patent and that said Letters Patent is hereby corrected as shown below:

Column 9,
Line 32, insert -- define -- after “first leg to”.

Signed and Sealed this

Fourth Day of February, 2003

JAMES E. ROGAN
*Director of the United States Patent and Trademark Office*